US008601920B2

(12) United States Patent
Edwards

(10) Patent No.: US 8,601,920 B2
(45) Date of Patent: Dec. 10, 2013

(54) HANDHELD CUTTER AND METHOD FOR CUTTING VINYL FLOOR COVERINGS

(76) Inventor: Greg Edwards, Quincy, IL (US)

( * ) Notice: Subject to any disclaimer, the term of this patent is extended or adjusted under 35 U.S.C. 154(b) by 272 days.

(21) Appl. No.: 12/708,484

(22) Filed: Feb. 18, 2010

(65) Prior Publication Data

US 2011/0197456 A1 Aug. 18, 2011

(51) Int. Cl.
*B26B 29/00* (2006.01)

(52) U.S. Cl.
USPC ..... 83/13; 30/293; 30/294; 30/320

(58) Field of Classification Search
USPC ..... 30/286–294, 314–317, 320, 478–493, 30/329–339
See application file for complete search history.

(56) References Cited

U.S. PATENT DOCUMENTS

| | | | | | |
|---|---|---|---|---|---|
| 886,750 | A | * | 5/1908 | White | 30/293 |
| 1,517,656 | A | * | 12/1924 | Steidinger | 30/486 |
| 1,557,204 | A | * | 10/1925 | Kenney | 30/478 |
| 1,901,764 | A | * | 3/1933 | Mosca | 30/287 |
| 1,996,224 | A | * | 4/1935 | Wedekind | 30/293 |
| 2,073,855 | A | * | 3/1937 | Steinmetz | 30/294 |
| 2,304,771 | A | * | 12/1942 | Davis | 30/294 |
| 2,770,879 | A | * | 11/1956 | Seymour | 30/293 |
| 2,772,474 | A | * | 12/1956 | Hill et al. | 30/293 |
| 3,133,350 | A | * | 5/1964 | Benson | 30/293 |
| 3,324,548 | A | * | 6/1967 | Mascia | 30/294 |
| 3,363,314 | A | * | 1/1968 | O'Brien | 30/287 |
| 3,382,579 | A | * | 5/1968 | Prater | 30/329 |
| 3,395,453 | A | * | 8/1968 | Prater | 30/293 |
| 3,482,310 | A | * | 12/1969 | Paterson | 30/293 |
| 3,535,786 | A | * | 10/1970 | Sanders | 30/293 |
| 3,581,397 | A | * | 6/1971 | Kochanowski | 30/293 |
| 3,605,267 | A | * | 9/1971 | Brenner | 30/287 |
| 3,726,010 | A | * | 4/1973 | Yokoyama | 30/293 |
| 3,737,932 | A | * | 6/1973 | Armijo | 30/293 |
| 3,772,785 | A | * | 11/1973 | Fischer | 30/293 |
| 3,787,971 | A | * | 1/1974 | Sutton et al. | 30/293 |
| 3,844,038 | A | * | 10/1974 | Kelly et al. | 30/293 |
| 3,934,341 | A | * | 1/1976 | Carlson | 30/287 |
| 3,934,342 | A | * | 1/1976 | Matsushita | 30/293 |
| 3,991,467 | A | * | 11/1976 | Yokoyama | 30/293 |
| 4,001,936 | A | * | 1/1977 | Matsushita | 30/287 |
| 4,095,341 | A | * | 6/1978 | Crain | 30/287 |
| 4,130,939 | A | * | 12/1978 | Toal | 30/293 |
| 4,213,572 | A | * | 7/1980 | Pallmann | 30/492 |

(Continued)

FOREIGN PATENT DOCUMENTS

| | | | |
|---|---|---|---|
| CH | 598921 | A5 * | 5/1978 |
| GB | 2277705 | A * | 11/1994 |

OTHER PUBLICATIONS

Vinyl Edger, http://vinyledger.com/, Aug. 15, 2012.*

*Primary Examiner* — Jason Daniel Prone

(57) ABSTRACT

A hand held cutting tool for cutting vinyl flooring material. The cutting tool has a tool body with a bottom surface configured to slide across the vinyl flooring material as it is being cut. The tool body holds a hook blade above the floor level, and angling slightly outward toward the wall, roughly pointing towards the intersection between the floor and the wall. The tool body is beveled underneath the hook blade to provide a space for the vinyl to curve up against the wall. The vinyl is placed on the floor, curving up against the wall with the cutting tool body pressing the excess vinyl against the wall as the hook blade slices through the vinyl.

19 Claims, 4 Drawing Sheets

(56) References Cited

U.S. PATENT DOCUMENTS

| | | | | | |
|---|---|---|---|---|---|
| 4,262,418 | A | * | 4/1981 | Hill et al. | 30/287 |
| 4,286,384 | A | * | 9/1981 | Kotchy | 30/287 |
| 4,330,939 | A | * | 5/1982 | Robinson | 30/289 |
| 4,501,069 | A | * | 2/1985 | Kohno | 30/293 |
| 5,075,974 | A | * | 12/1991 | McIlhatten | 30/290 |
| 5,189,795 | A | * | 3/1993 | Fortin | 30/294 |
| 5,325,594 | A | * | 7/1994 | Szafranski | 30/294 |
| 5,410,813 | A | * | 5/1995 | Carlson | 30/287 |
| 5,848,471 | A | * | 12/1998 | Freeland | 30/294 |
| 6,029,355 | A | * | 2/2000 | Carlin | 30/317 |
| 6,112,417 | A | * | 9/2000 | Hyer et al. | 30/315 |
| 6,230,410 | B1 | * | 5/2001 | Taylor et al. | 30/293 |
| 6,421,923 | B1 | * | 7/2002 | Nguyen | 30/287 |
| 6,612,036 | B2 | * | 9/2003 | Frazier | 30/293 |
| 6,671,968 | B2 | * | 1/2004 | Shannon | 30/294 |
| 6,718,642 | B2 | * | 4/2004 | Collins | 30/492 |
| 6,895,674 | B2 | * | 5/2005 | Ai | 30/314 |
| 6,941,664 | B1 | * | 9/2005 | Engle et al. | 30/286 |
| 7,356,932 | B1 | * | 4/2008 | Nguyen et al. | 30/287 |
| 7,565,747 | B2 | * | 7/2009 | Cobb et al. | 30/329 |
| 7,788,812 | B2 | * | 9/2010 | Nguyen et al. | 30/287 |
| 8,136,255 | B1 | * | 3/2012 | Reel | 30/287 |
| 2002/0014012 | A1 | * | 2/2002 | Hoffman | 30/293 |
| 2007/0283572 | A1 | * | 12/2007 | Saiz | 30/314 |

* cited by examiner

HANDHELD CUTTER AND METHOD FOR CUTTING VINYL FLOOR COVERINGS

BACKGROUND

1. Field of the Invention

The present invention relates to handheld tools, and more specifically, to a handheld cutter for vinyl floor coverings.

2. Description of Related Art

The use of vinyl floor covering materials is quite common in the construction of both homes and commercial buildings. Vinyl floor covering materials are durable, come in a wide variety of colors and textures, and can be relatively inexpensive. A skilled craftsman experienced in the installation of vinyl floor coverings can generally install the material on the floors of several rooms in a matter of hours. However, inexperienced construction workers, or homeowners attempting the installation themselves, often run into difficulties. It can be difficult to get the vinyl floor covering materials to fit neatly in corners and tight spaces. It can also be difficult to make a straight cut so the vinyl floor covering lies a uniform distance from the wall. Quite often the inexperienced installer will end up with unsightly installation flaws, and will sometimes waste material in repeated attempts to get an acceptable fit.

What is needed is an improved way of cutting and installing vinyl floor coverings.

SUMMARY

This disclosure addresses the above stated needs by providing various embodiments of vinyl cutting tools and methods of using the tools for cutting vinyl floor coverings. Various embodiments are drawn to a cutting tool for cutting flexible flooring material. The tool has a tool body with a bottom surface that slides across the flooring material as it is being cut. The tool body also has a blade holding portion that is shaped to receive a hook blade inserted into it, and hold the hook blade for cutting the flexible flooring material. The blade holding mechanism removably affixes the hook blade to the blade holding portion in an orientation parallel to a surface of the blade holding portion, and closer to the trailing edge than the leading edge of the tool. In accordance with various embodiments the blade holding mechanism holds the bottom most part of the hook blade (e.g., the hook blade tip) above the level of the bottom surface of the tool. The excess vinyl is curled up against the wall, and the cutting tool's hook blade cuts the vinyl at a point near the wall where it curls up. The cutting edge of the hook blade faces the leading edge of the tool body relative to a direction of cutting.

In some embodiments the orientation of the hook blade is reversible in order to change the cutting direction. In other embodiments there are two hook blades, and a different hook blade is used for cutting in either direction.

BRIEF DESCRIPTION OF THE DRAWINGS

The accompanying drawings, which are incorporated in and constitute part of the specification, illustrate various embodiments of the invention. Together with the general description, the drawings serve to explain the principles of the invention. In the drawings.

DETAILED DESCRIPTION

Figure 1A:
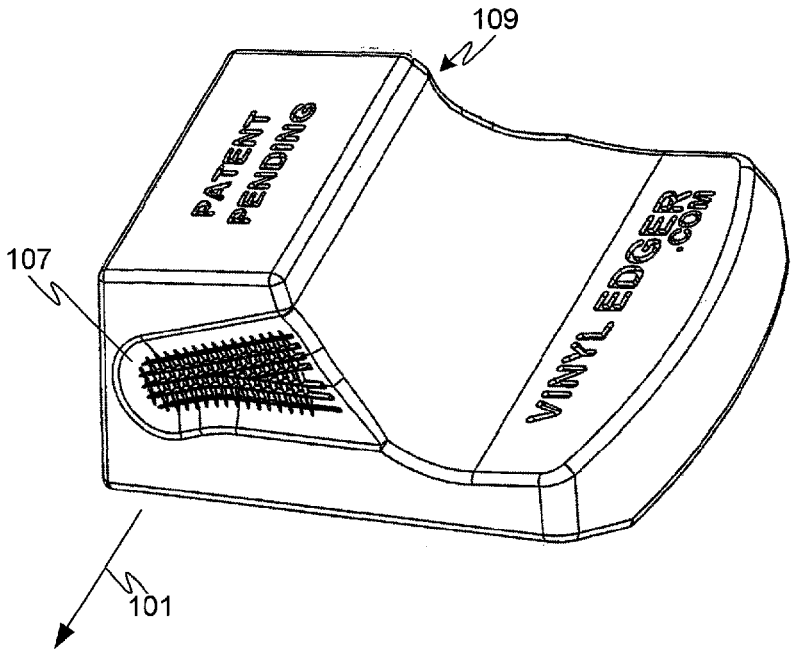
FIG. 1A depicts an oblique view of the hand-hold side of one embodiment of the tool from a top perspective.
Figure 1B:
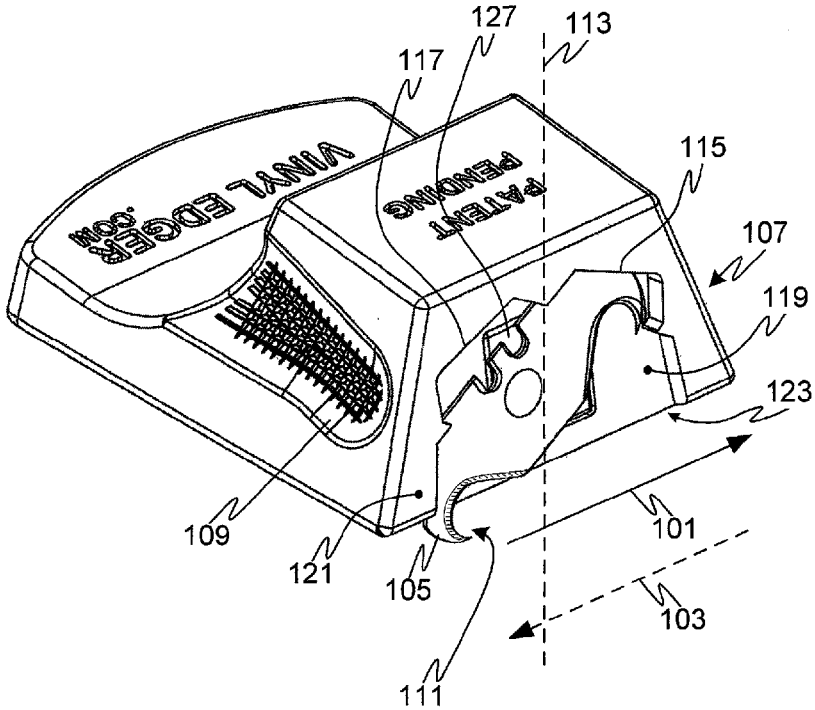
FIG. 1B depicts an oblique view of the cutting blade side of the tool from a top perspective.

FIGS. 1A and 1B depict oblique views of a vinyl cutting tool according to one embodiment. FIG. 1A depicts an oblique view of the hand-hold side of one embodiment of the tool from a top perspective. FIG. 1B depicts another oblique view of the cutting blade side of the same embodiment of the tool, also from a top perspective. In the view of FIG. 1B, the tool is rotated approximately 135 degrees counter clockwise as compared to the view of FIG. 1A. The vinyl cutting tool shown in FIG. 1B is intended to cut in the direction of arrow 101, with the hook blade 105 nearer to the trailing edge than to the leading edge of the tool relative to the cutting motion. The phrase nearer to the trailing edge than to the leading edge means that the hook blade 105 is behind the centerline 113 of the tool relative to the cutting direction 101. In other words the cutting edge 111 of hook blade 105 faces toward the cutting direction 101 and the tip of hook blade 105 is typically behind the centerline 113 of the tool (towards the trailing edge). The extent that hook blade 105 is positioned toward the trailing edge as compared to the leading edge of the tool can vary, depending upon the specifics of the implementation. The orientation toward the trailing edge can be measured by the position of the hook blade tip in relation to the leading and trailing edges of the tool (e.g., the corners of the tool closest to the wall ahead of and behind the hook blade). In the embodiment depicted in FIG. 1B hook blade 105 (as measured by the tip position) is approximately 75% of the way towards the trailing edge as compared to the leading edge. In some embodiments the tip of hook blade 105 may hang out past the trailing edge while in other embodiments the tip of hook blade 105 may be positioned as far forward as the centerline 113, or at any position or range of positions between these two points. Some implementations may even have the hook blade positioned ahead of the centerline 113, although the stability of the tool tends to be better if the blade is positioned at the centerline or further back relative to the cutting direction.

Various embodiments use a hook blade 105 which is a cutting blade with a concave cutting edge. Most embodiments of the hook blade have a sharp tip at the end. Various embodiments use a hook blade with a sharpened cutting edge around an arc at least 90 along an interior curve of the blade. The hook blade depicted in FIG. 1B is a model 11-961 hook blade from the Stanley Tool Company™. The model 11-961 is typical of the type of hook blade that may be used, although different hook blades may be used in various embodiments. The hook blade may be made from various materials, including steel, stainless steel, or any of a number of alloys known to those of skill in the cutting instrument art that would be sufficient for cutting vinyl flooring.

In FIGS. 1A and 1B, so long as the hook blade 105 is affixed in the same position in both views, the cutting motion will be the same relative to both tools. That is, cutting direction 101 relative to the tool shown in FIG. 1A is the same direction relative to the tool as cutting direction 101 shown for the tool shown in FIG. 1B. However, in various embodiments the hook blade 105 can be moved to the opposite side of the tool to cut in the other direction. The hook blade 105 is removably affixed to a blade holding face 121 of the tool. The term "removably affixed" means that the hook blade 105 can be affixed to the tool for cutting, and then be removed from the tool, either for replacement, to flip the blade over (to a sharper cutting edge) for cutting in the same direction, or to change the orientation of the blade to reverse the cutting direction. The embodiment of FIG. 1B depicts a recessed (or depressed) blade holding portion 119 of the blade holding face 121 shaped to receive a hook blade 105—that is, to have a hook blade 105 inserted into the recessed blade holding portion 119. FIG. 1B depicts the upper end of the cutting blade resting against an upper edge 115 of the recessed blade holding portion 119.

The cutting direction may be reversed in FIG. 1B by removing the hook blade 105, and flipping it over laterally so that its upper edge rests against upper edge 117 of the blade holding portion. When the blade is reversed in this manner the hook end of hook blade 105 will be nearest the point 123 of blade holding portion 119, and the cutting direction will then be the direction of dashed line 103. In the embodiment depicted in FIG. 1B the recessed blade holding portion 119 provides a close fit to hold hook blade 105 thinly in place with little or no movement of hook blade 105 on the tool during the cutting operation. The tolerances of the tool are such that hook blade 105 fits snugly within recessed blade holding portion 119. In the embodiment shown in the figures the hook blade 105 is held in place with magnet 127. Other implementations use various other blade holding means, including for example, a threaded bolt, a latch mechanism, a sliding gate mechanism, a hole into which the blade can be inserted, or any other such holding mechanisms known to those skilled in the art. Aspects of the removal and reversal of the tool's cutting blade is also described in conjunction with FIGS. 2A-C.

The tool may be grasped in any manner that is comfortable for the user to firmly grip the tool as it is being moved in a cutting direction. For example, in the embodiments depicted in FIGS. 1A and 1B with the cutting directions as shown with arrows 101 and 103, a right handed user might grasp the tool body placing his (or her) right thumb at gripping portion 107 and one or more fingers on gripping portion 109. This allows the tool to be held firmly to press the vinyl flat against the floor underneath the tool's body. The front edge (the end towards the blade) of the bottom portion of the vinyl cutting tool is beveled to provide a gap between the hook blade 105 and the bottom portion of the tool that rests firmly against the vinyl as it is being cut. This beveled edge cannot be seen in the views of FIGS. 1A and 1B due to the angle looking from above. This beveled edge is shown in the cross-sectional view of the vinyl relative to the tool of FIG. 2A.

Figure 2A:
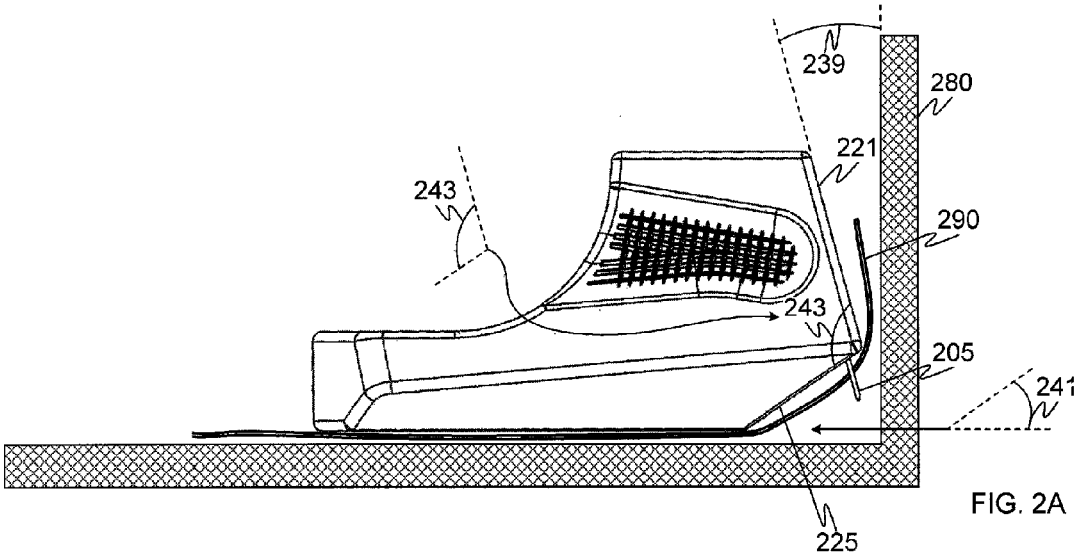
FIG. 2A depicts a side view of one embodiment of the tool.

FIG. 2A depicts a side view of one embodiment of the cutting tool. In this view the cutting blade 205 can be seen slicing through a piece of vinyl 290 that is positioned on a floor near a wall 280 with the excess vinyl to be trimmed off curling up against the wall. When installing vinyl flooring it would be quite difficult to cut the vinyl to fit up against the walls before laying it down. Professional installers typically use a piece of vinyl flooring material that is somewhat larger than needed, and then trim the excess off near the wall so the material is right sized.

Various embodiments of the cutting tool feature a bevel face 225 adjacent the hook blade 205. The bevel face 225 allows the vinyl to curl up from the floor against the wall 280 while the bottom surface 229 of the tool presses the vinyl firmly against the floor. The space in front of and beneath the bevel face 225 provides room for the bend of the vinyl, since vinyl flooring won't easily bend at a 90 degree angle without cracking or wrinkling. The bevel face 225 also raises the bottom edge of the blade holding face 221 up off the floor level, providing a space for the hook blade 205 to hang down without reaching the floor level or the level of the bottom surface 229 of the tool. In this way the tool's bottom surface 229 can be pressed against the vinyl 290, holding it against the floor without dragging the hook blade 205 on the floor while the tool is being moved to cut the vinyl.

Figure 2B:
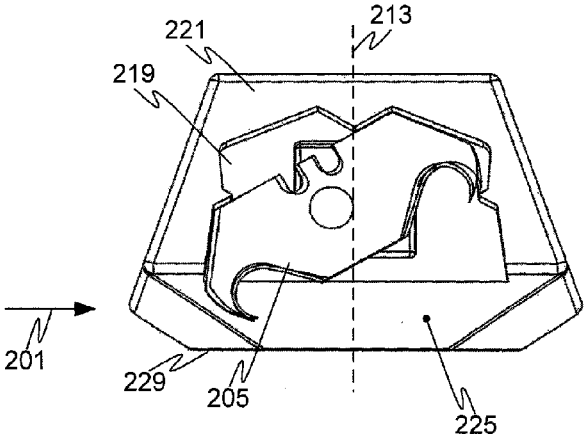
FIG. 2B depicts a front view of the blade holding face of the tool with the blade installed to make a left cut as viewed from behind the tool.
Figure 2C:
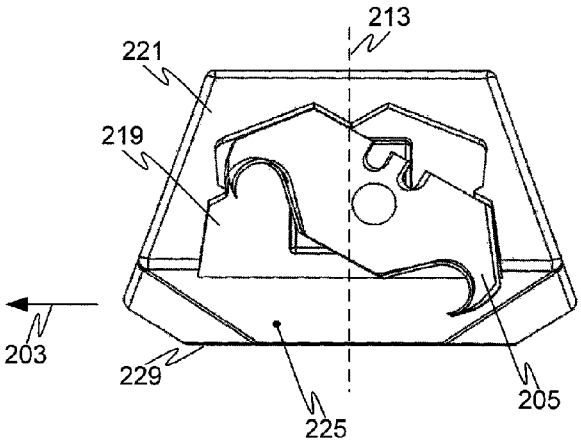
FIG. 2C depicts a front view of the blade holding face of the tool with the blade installed to make a right cut.

The bevel face 225 depicted in FIGS. 2A-2C is approximately ¾ inch in width, where the width is defined as the distance (measured behind centerline 213) from the edge intersecting bottom surface 229 up to the edge of the bevel face intersecting the blade holding portion 219. (The tool shown in FIGS. 2A-2C is approximately the actual size of one embodiment). The ¾ inch face width for the bevel face 225 is a typical value. However, in other embodiments the bevel face 225 can have a width as small as ⅛ inch to a width of 2 inches, or any range of widths or particular width value in between these two values. By cutting the vinyl 290 at a point part way up from the floor as the excess curls up against the wall, the cut vinyl will drop down very close to the edge of the wall, producing a straight cut which leaves the finished vinyl floor material the desired small gap away from the wall (e.g., often ⅛ inch to ⅜ inch, or other distance desired by the craftsman installing the vinyl). It is generally desirable to leave a small gap between the vinyl and the wall to avoid wrinkling in case the vinyl shifts or expands after it is laid.

In some embodiments the bottom surface 229 may be covered with a smooth material or durable fabric that aids in avoiding scratches to the surface of the vinyl 290 as it is being cut. Various implementations of the tool have bevel faces 225 at a number of different angles. The bevel angle 241 shown in FIG. 2A is approximately 35 degrees. While a bevel angle within the range of 20 to 50 degrees is typical, in various implementations the bevel angle may be as great as 80 degrees or as small as 10 degrees, or any value or range within these two values, so long as the bevel angle and width of the bevel face is sufficient to keep the tip of the hook blade 205 above the level of the tool's bottom surface 229.

FIG. 2B depicts a front view of the cutting blade side of the tool with the blade installed to make a cut in direction 201, a left moving cut as seen from the user's perspective behind the tool. FIG. 2C depicts the same embodiment from a front view looking at the cutting blade side of the tool, with the blade reversed to make a cut in direction 203. The views of FIGS. 2B and 2C show that the recessed blade holding portion 219 of the blade holding face 221 is configured to accept the blade for cutting in either direction, right or left. As depicted in FIGS. 2A-2C in various embodiments the tip of hook blade 205 does not extend down to the level of the tool's bottom surface 229.

In various embodiments the blade holding face 221 is angled away from the wall 280. This angle—called blade angle 239—allows the vinyl material 290 to curl up against the wall into the excess space afforded by angling the blade holding face 221 and providing the bevel face 225. The space between the wall 280 and blade holding face 221 created by blade angle 239 is especially useful if the excess of vinyl is more than a couple of inches long since the excess vinyl often has a tendency to curl back away from the wall over the top of the tool. This space is also useful when cutting interior angles. It helps to keep the leading edge of blade holding face 221 rubbing against the wall in a tight interior bend, or scraping on the vinyl 290 that is bent up against the wall. In the embodiments depicted in the figures the recessed blade holding portion 219 is configured at the same angle as blade holding face 221. Not all implementations are configured in this manner. In some embodiments the angle of the hook blade 205 may be more, or may be less, than the blade holding face 221.

In the embodiment depicted in FIG. 2A the blade angle 239 is approximately 15 degrees. This is a typical angle for hook blade 205 and for blade holding face 221. If the blade angle is too great (blade too close to horizontal), the craftsman using the tool runs the risk of scratching the wall 280 should the blade come into contact with the wall. However, if the blade angle is too small (blade too close to vertical) then the blade will cut the vinyl at too much of an angle—that is, at an angle too far from perpendicular to the surface of the vinyl which is curving up towards the wall. In a typical implementation the blade angle 239 may be anywhere within the range of 8 degrees to 30 degrees, with 15 degrees being a typical blade angle. However, in some embodiments the angle 239 for hook blade 205 and for blade holding face 221 (and blade holding portion 219) may be any of a number of other angles, or ranges of angles, including, for example, any angle or range of angles between 0 degrees (vertical) and 60 degrees.

Angle 243, as shown in FIG. 2A, is the angle between the blade holding face 221 (or hook blade 205) and the bevel face 225. For the embodiment shown in the figures angle 243 is approximately 110 degrees. Typically, angle 243 it generally within the range of 85 degrees to 130 degrees, and is larger than 90 degrees for many implementations. However, in various embodiments angle 243 between the blade holding face 221 (or hook blade 205) and the bevel face 225 may be as much as 160 degrees or as little as 30 degrees, or any angle or range of angles between these two values.

FIGS. 2A-2C depict the various faces of the tool body to be flat, planar surfaces. In some embodiments one or more of the tool body faces may be curved or otherwise non-planar surfaces. For example, in some embodiments the bevel face 225 is not a flat surface as depicted in the figures, but rather is a gently curving surface which curves up from bottom surface 229. In such embodiments where a relatively flat bottom surface meets a curved face (e.g., bevel face), the curved bevel face can be defined to begin at a point where the bevel angle reaches 3 degrees from horizontal (or from the plane of the bottom surface). In some embodiments the bottom surface 229 and/or the blade holding face 221 may have a gentle curve or non-planar surface as well. In various other embodiments any of the different surfaces and faces of the tool body shown to be flat in the figures may have curving or sloping surfaces. Any of the surfaces or faces of the device is said to be substantially flat along a given line segment if the radius of curvature between the two points at the end of the segment is at least ten times greater than the length of the line segment. If the majority of a surface or face is substantially flat then the surface or face is said to be substantially flat.

Figure 3A:
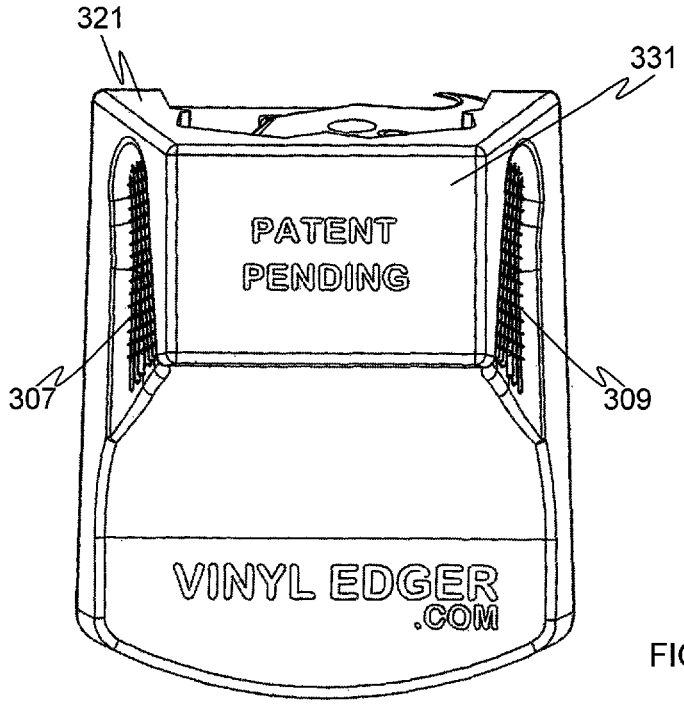
FIG. 3A depicts a top view of one embodiment of the tool.
Figure 3B:
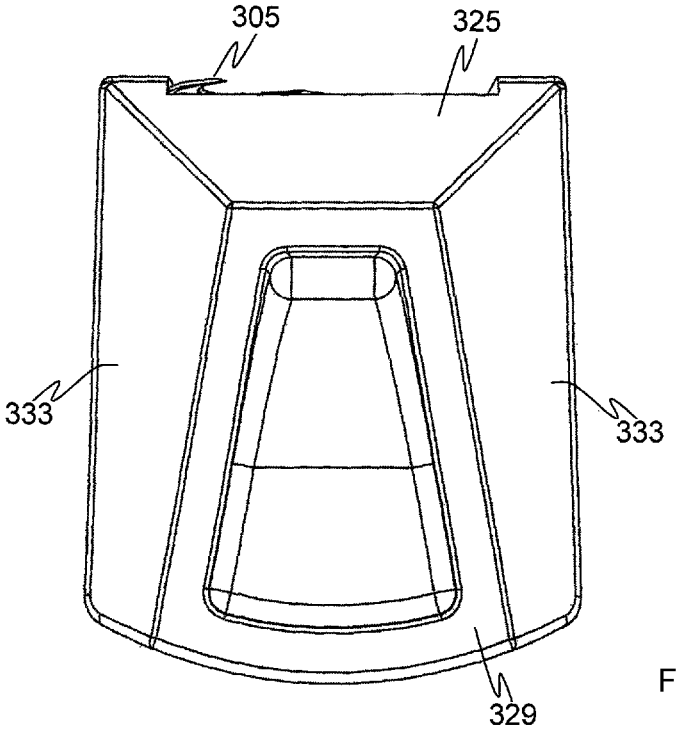
FIG. 3B depicts a bottom view of one embodiment of the tool.

FIG. 3A depicts a top view of the embodiment of the tool shown in FIGS. 1-2, and FIG. 3B depicts the bottom view the same embodiment. Various embodiments of the cutting tool are configured with a top surface 331 upon which the user can rest his hand while cutting vinyl. Various embodiments of the tool come in different sizes. For each embodiment there is typically a hand grip portion on or near the top configured to comfortably fit in the hand of a craftsman. For example, FIG. 3A depicts gripping portions 307 and 309 to aid in firmly grasping the tool as it is being used to slice through the vinyl floor covering material.

FIG. 3B depicts the bottom view of the embodiment of the tool shown in FIGS. 1 and 2. The bevel face 325 can be seen in the bottom view of FIG. 3B. The bevel face 325 intersects the bottom surface 329 on its lower edge. The bevel face 325 intersects the blade holding face 321 on its upper edge. This can be seen by comparing FIG. 3A with FIG. 3B, or by viewing FIG. 2A. Moreover, in the embodiment shown the sides are beveled as well, as can be seen by portions 333. Having a beveled side portion 333 on the leading edge of the tool—the front edge in the direction of movement—helps to smooth the vinyl down into place as the tool is moved along to make its cut. The bottom view of FIG. 3B also shows the blade 305 protruding from the recessed blade holding portion on the blade holding face.

Figure 4A:
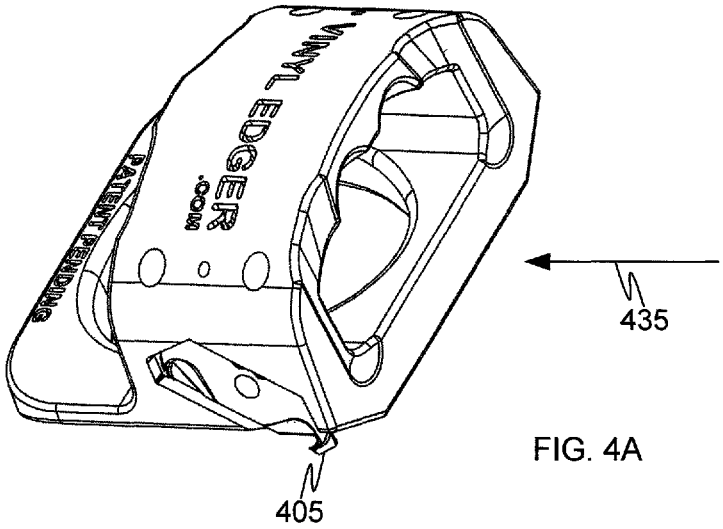
FIGS. 4A-B depict oblique views of an embodiment of the cutting tool that has two blades.
Figure 4B:
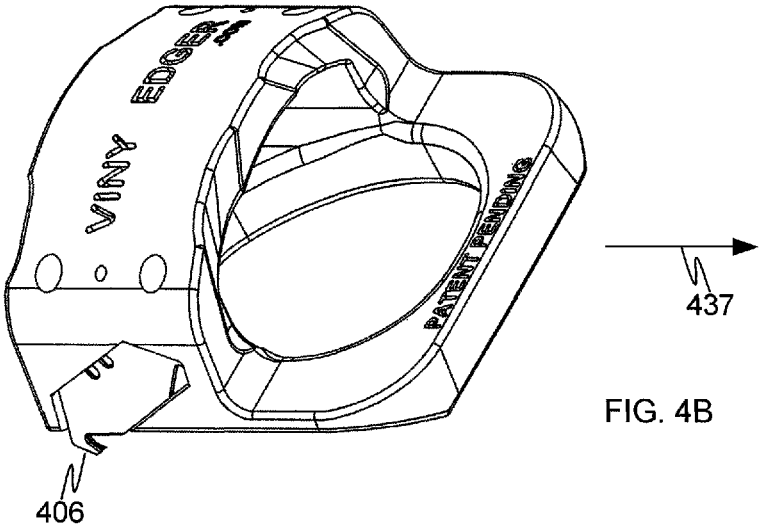
Figure 4C:
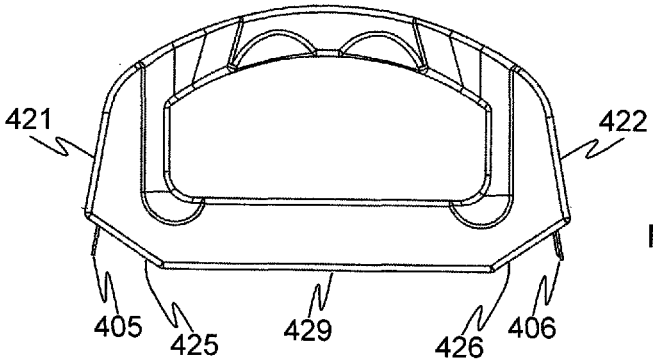
FIG. 4C depicts a side view of a two blade embodiment of the cutting tool.

FIGS. 4A-B depict oblique views of an embodiment of the cutting tool that has two blades. This embodiment has similarities to the embodiment of FIGS. 1-3, but differs in several key respects. The embodiment of FIG. 4 is similar in that it uses a hook blade to cut the vinyl. However, rather than reversing the hook blade to change cutting directions, the embodiment of FIG. 4 is equipped with a hook blade on each side, hook blade 405 and hook blade 406. Positioning the tool as shown in FIG. 4A allows the user to make a cut to the left in direction 435. Positioning the tool as shown in FIG. 4B allows the user to make a cut to the right in direction 437. Since the tool depicted in FIGS. 4A-C has two cutting blades, this embodiment has two bevel faces 425 and 426, as well as two blade holding faces 421 and 422.

Hook blade 405 is for cutting in one direction and hook blade 406 is for cutting in the other direction. Like the embodiment depicted in FIGS. 1-3, hook blades 405 and 406 do not extend down to the level of bottom surface bottom surface 429. This can be seen in FIG. 4C which depicts a side view of the two blade embodiment of the cutting tool looking from direction 435 shown in FIG. 4A. Another similarity to the embodiment of FIGS. 1-3 is that the blade is removable so it can be conveniently replaced, or flipped around to use the other end when it becomes dull (for blades with a hook at both ends). Since the hook blades do not extend down to the floor level, the tool can be used for cutting while keeping both blades snapped into place. Alternatively, it is easy to remove one of the blades while cutting with the other to avoid the possibility of tipping the tool up during cutting and scratching the vinyl floor covering.

The cutting tool has been described herein in terms of the tool body having several different faces and surfaces. In some implementations the faces may be gently curved and the intersection between the faces may be rounded rather than being a sharp edge. It can sometimes be difficult to tell where one face ends and the other face or surface begins when the intersection bounding the two faces is curved or rounded. In such instances a plane can be drawn from both surfaces (or from the average plane of surface face if the face is curved). The intersection of the two imaginary planes is bisected back towards the tool body to find the intersection of the two faces.

The various embodiments of the cutting tool, as described herein, are drawn to a handheld tool for cutting vinyl or other flooring materials. The tool does not have a motor or source of power other than that provided by the user. Instead, the tool is pushed (or pulled) by hand, allowing the hook blade to cut through the vinyl. The body and handgrips of the vinyl cutting tool may be made from any of a number of materials known to be used in making handheld tools. These materials include various types of plastics and polymer materials, metals, wood, or any material which may be molded or machined to the proper shape, and having sufficient strength to hold the hook blade while cutting the vinyl flooring material.

For the purposes of explanation and disclosure the various embodiments have been described in terms of cutting vinyl floor covering materials. However, the tool may be used to cut any type of flexible floor covering material or flexible material of including, for example, plastic and polymer matting materials, rubber mats, flexible wall panels, linoleum sheets, or any relatively flat material flexible enough to be bent up against a wall and suitable for cutting with a hand tool that is known by those of ordinary skill in the art. Furthermore, although the tool has been described in terms of cutting a vinyl flooring material, it may be used to cut any suitable material that needs to be cut to fit on a surface against a wall or other obstruction that intersects the surface such that the material being cut bends up against the wall in a manner that facilitates cutting by the hook blade.

The Stanley model 11-961 hook blade from the Stanley Tool Company™ is depicted in the various figures of this application. Other types and brands of hook blades may be used in various embodiments. A hook blade is a blade with a concave cutting edge that may, or may not end in a sharpened tip. Various sizes and shapes of hook blades can be used with the different embodiments and implementations of the present invention. A typical sized hook blade may have a cutting edge (sharpened edge) that is no more than ½ inch long and the amount of concave is no less than 3/32 inch. However, in some embodiments having a small hook blade the cutting edge may be no more than ¼ inch long and the amount of concave is no less than 3/64 inch. In other, larger embodiments the cutting edge may be up to 2 inches long with an amount of concave of no less than ⅜ inch. Various other embodiments may use a hook blade in any dimension or range between the sizes mentioned above.

The description of the various embodiments provided above is illustrative in nature inasmuch as it is not intended to limit the invention, its application, or uses. Thus, variations that do not depart from the intents or purposes of the invention are intended to be encompassed by the various embodiments of the present invention. Such variations are not to be regarded as a departure from the intended scope of the present invention.

What is claimed is:

1. A cutting tool configured to cut flexible flooring material covering a floor surface to be fit along a wall perpendicular to the floor surface, the cutting tool comprising:

a blade having a cutting edge and a tool body having a flat base surface and a substantially flat blade holding face having a bottom edge that extends furthest of any portion of the tool body along a plane parallel to the base surface, wherein the blade holding face is inwardly beveled so that a space is defined between a majority of the blade holding face and the wall perpendicular to the floor surface when the base surface is on the floor surface, the blade holding face including a recessed blade receiving portion with a holding member to receive and hold the blade above a plane defined by the base surface, wherein when the base surface is slid across the flooring material in a cutting direction thereby defining a lead edge of the tool body, a portion of the cutting edge facing the lead edge cuts the flooring material while the bottom edge of the blade holding face presses the flooring material against the wall with the inward bevel of the blade holding face permitting an end of the flooring material to curl in the space between the majority of the blade holding face and the wall perpendicular to the floor surface.

2. The cutting tool of claim 1, wherein the cutting direction defines a trailing edge of the tool body and the holding member holds the blade closer to the trailing edge than the leading edge of the tool body.

3. The cutting tool of claim 1, wherein the blade is a hook blade.

4. The cutting tool of claim 1, wherein the tool body further comprises a bevel face having a lower edge that intersects an edge of the base surface and an upper edge that intersects the bottom edge of the blade holding face, wherein when the base surface is on the floor surface the bevel face allows for a second space between the floor surface and the bevel face permitting the flooring material to curl up.

5. The cutting tool of claim 4, wherein the bevel face is substantially flat.

6. The cutting tool of claim 4, an angle between the bevel face and the plane defined by the base surface is at least 25 degrees.

7. The cutting tool of claim 6, the angle is not greater than 45 degrees.

8. The cutting tool of claim 4, the holding member holds the blade in front of the bevel face to cut the flooring material at a point above the floor surface where the flooring material curls up and below where the flooring material is pressed by the bottom edge against the wall.

9. The cutting tool of claim 1, wherein the recessed blade receiving portion allows for an orientation of the blade to be reversed to change the direction of cutting.

10. A method of cutting flexible flooring material covering a floor surface to be fit along a wall perpendicular to the floor surface utilizing the cutting tool of claim 1, the method comprising:

pressing the flooring material against the floor surface with the base surface of the cutting tool and against the wall with the bottom edge of the blade holding face, wherein the flooring material curls in the space between the majority of the blade holding face and the wall perpendicular to the floor surface and cutting the flooring material while the cutting tool is sliding across the flooring material in the cutting direction.

11. The method of claim 10, wherein the cutting direction defines a trailing edge of the tool body and the holding member holds the blade closer to the trailing edge than the leading edge of the tool body.

12. The method of claim 10, wherein the tool body further comprises a bevel face having a lower edge that intersects an edge of the base surface and an upper edge that intersects the bottom edge of the blade holding face, wherein when the base surface is on the floor surface the bevel face allows for a second space between the floor surface and the bevel face permitting the flooring material to curl up.

13. The method of claim 12, an angle between the bevel face and the plane defined by the base surface is at least 25 degrees.

14. The method of claim 13, the angle is not greater than 45 degrees.

15. The method of claim 12, the holding member holds the blade in front of the bevel face so the cutting of the flooring material is at a point above the floor surface where the flooring material curls up and below where the flooring material is pressed by the bottom edge against the wall.

16. The method of claim 12, wherein the bevel face is substantially flat.

17. The method of claim 10, wherein the recessed blade receiving portion allows for an orientation of the blade to be reversed to change the direction of cutting.

18. The method of claim 10, wherein the flexible flooring material is a vinyl sheet material.

19. The method of claim 10, wherein the blade is a hook blade.

* * * * *